US009431185B2

(12) United States Patent
Tanigaki et al.

(10) Patent No.: US 9,431,185 B2
(45) Date of Patent: Aug. 30, 2016

(54) SPRING OPERATION DEVICE FOR SWITCHGEAR

(71) Applicants: Shuichi Tanigaki, Tokyo (JP); Tomohito Mori, Tokyo (JP)

(72) Inventors: Shuichi Tanigaki, Tokyo (JP); Tomohito Mori, Tokyo (JP)

(73) Assignee: MITSUBISHI ELECTRIC CORPORATION, Chiyoda-Ku, Tokyo (JP)

( * ) Notice: Subject to any disclaimer, the term of this patent is extended or adjusted under 35 U.S.C. 154(b) by 0 days.

(21) Appl. No.: 14/426,917

(22) PCT Filed: Nov. 1, 2012

(86) PCT No.: PCT/JP2012/078345

§ 371 (c)(1),
(2) Date: Mar. 9, 2015

(87) PCT Pub. No.: WO2014/068751

PCT Pub. Date: May 8, 2014

(65) Prior Publication Data

US 2015/0228418 A1 Aug. 13, 2015

(51) Int. Cl.
*H01H 9/20* (2006.01)
*H01H 3/38* (2006.01)
(Continued)

(52) U.S. Cl.
CPC ..... *H01H 3/38* (2013.01); *H01H 3/28* (2013.01); *H01H 3/3031* (2013.01); *H01H 9/20* (2013.01); *H01H 2235/01* (2013.01)

(58) Field of Classification Search
CPC ..... H01H 3/38; H01H 9/00; H01H 9/20; H01H 3/00; H01H 5/00; H01H 2235/01
USPC ..... 335/171
See application file for complete search history.

(56) References Cited

U.S. PATENT DOCUMENTS 4,839,476 A * 6/1989 Okuno ..... H01H 3/3042 200/17 R
6,232,569 B1 * 5/2001 Nakajima ..... H01H 3/3042 200/17 R (Continued)

FOREIGN PATENT DOCUMENTS

JP 58-46530 A 3/1983
JP 62-59404 B2 12/1987

(Continued)

OTHER PUBLICATIONS

International Search Report (PCT/ISA/210) mailed on Jan. 29, 2013, by the Japanese Patent Office as the International Searching Authority for International Application No. PCT/JP2012/078345.

(Continued)

*Primary Examiner* — Shawki S Ismail
*Assistant Examiner* — Lisa Homza
(74) *Attorney, Agent, or Firm* — Buchanan Ingersoll & Rooney PC

(57) ABSTRACT

A spring operation device for use in a switchgear includes an interlock bar, attached at its one end to a lock plate and includes a switch-on electromagnet that has a plunger provided with a flange portion. The lock plate is pushed by a lock member that is attached to a four-joint link and the position of the lock plate is changed by being rotated. During an opening operation of a switching contact, the other end of the interlock bar is arranged above the flange portion to stop the forward movement of the plunger of the switch-on electromagnet so as to prevent a switch-on trigger from rotating. During a closing operation of the switching contact, the other end of the interlock bar is arranged at a position that does not stop the plunger of the switch-on electromagnet from moving forward so that the switch-on trigger is allowed to rotate.

4 Claims, 10 Drawing Sheets

(51) Int. Cl.
*H01H 3/28* (2006.01)
*H01H 3/30* (2006.01)

(56) References Cited

U.S. PATENT DOCUMENTS

| | | | | |
|---|---|---|---|---|
| 6,316,739 | B1 * | 11/2001 | Ohtsuka | H01H 3/30 200/400 |
| 6,348,847 | B1 * | 2/2002 | Nakajima | H01H 3/3031 200/17 R |
| 8,330,065 | B2 | 12/2012 | Ohda et al. | |
| 2002/0056631 | A1 * | 5/2002 | Ohtsuka | H01H 3/3042 200/400 |
| 2003/0034242 | A1 * | 2/2003 | Mori | H01H 3/3015 200/400 |
| 2010/0164659 | A1 * | 7/2010 | Ohtsuka | H01H 3/30 335/174 |

FOREIGN PATENT DOCUMENTS

| | | | |
|---|---|---|---|
| JP | 3-50373 | B2 | 8/1991 |
| JP | 6-24112 | Y2 | 6/1994 |
| JP | 7-8937 | U | 2/1995 |
| JP | 2000-040445 | A | 2/2000 |
| JP | 2002-063839 | A | 2/2002 |
| JP | 2002-150900 | A | 5/2002 |
| JP | 2002-157946 | A | 5/2002 |
| JP | 2003-059375 | A | 2/2003 |
| JP | 3808328 | B2 | 8/2006 |
| JP | 2008-123727 | A | 5/2008 |
| WO | WO 2009/016814 | A1 | 2/2009 |

OTHER PUBLICATIONS

Written Opinion (PCT/ISA/237) mailed on Jan. 29, 2013, by the Japanese Patent Office as the International Searching Authority for International Application No. PCT/JP2012/078345.

* cited by examiner

SPRING OPERATION DEVICE FOR SWITCHGEAR

FIELD

The present invention relates to a spring operation device for use in a switchgear such as a breaker provided in a substation or a switching station.

BACKGROUND

In FIG. 31 of Patent Literature 1, a spring operation device for use in a switchgear is depicted in which the device includes two springs: an opening coil spring and a closing coil spring. In this conventional spring operation device, when the biased closing coil spring is released during a closing operation, a switch-on lever rotates about a main shaft under a condition where a guide engages with a first tripping latch, the first tripping latch engages with a tripping trigger, and the tripping trigger engages with a lock plate. In response to this rotation, a four-joint link (a first link, a second link, and a second blocking lever) rotates about the main shaft, while being supported by the guide. Further, a first blocking lever rotates about the main shaft and then compresses and biases the opening spring so as to close the breaker.

In the spring operation device described in Patent Literature 1 mentioned above, a first lock member and the lock plate are provided, and the lock plate locks the tripping trigger during a closing operation. Consequently, even when an opening command is improperly input and a tripping electromagnet is thus energized, the tripping trigger is configured so as not to rotate and perform an opening operation. The lock plate is configured so as to be pushed out by the first lock member and to disengage from the tripping trigger when the closing operation has been completed. Therefore, the spring operation device is in a state where it is capable of performing an opening operation.

In the spring operation device described in Patent Literature 2, a switch-on stopping device is provided, as illustrated in FIG. 3 of the Patent Literature, in order to prevent a closing operation from being performed immediately after an opening operation. Engagement of a trigger lever with a switch-on trigger is controlled by using an interlocking electromagnet. In this conventional spring operation device, even when a switch-on electromagnet is energized during an opening operation, the switch-on trigger is not driven and therefore a switch-on operation is prevented from being performed.

CITATION LIST

Patent Literatures

Patent Literature 1: Japanese Patent No. 3808328

Patent Literature 2: Japanese Patent Application Laid-open No. 2002-157946

SUMMARY

Technical Problem

As described above, the spring operation device described in Patent Literature 1 has a structure in which upon performing a closing operation, the opening coil spring is compressed such that the guide, the first tripping latch, the tripping trigger, and the lock plate engage with each other.

However, over the course of an opening operation for example, the guide, the first tripping latch, the tripping trigger, and the lock plate disengage from each other, so that, in this state, a closing command is improperly input and the four-joint link cannot be supported by the guide and is thus brought into a non-rotatable state. Consequently, the opening coil spring is not biased and its load decreases accordingly and therefore the closing speed increases. This leads to a problem where the spring operation device may be damaged.

In the spring operation device described in Patent Literature 2, the switch-on stopping device is provided with an additional electromagnet in order to prevent a closing operation from being performed during an opening operation. With this technique, it is necessary to modify the control circuit so that a command also is transmitted to the electromagnet used for the switch-on stopping device (the interlocking electromagnet). This leads to problems such as the control circuit becoming more complicated, the spring operation device becoming a more complicated structure, and size of the spring operation device increasing.

The present invention has been achieved to solve the above problems, and an objective of the present invention is to provide a spring operation device for use in a switchgear that has a simple structure and is capable of preventing a closing operation from being performed during an opening operation.

Solution to Problem

To solve the problem and achieve the objective, the present invention relates to a spring operation device for use in a switchgear. The spring operation device includes: a main shaft that is rotatably supported by a casing; an output lever that is fixed to the main shaft, is rotatable about the main axis, and is coupled to a switching contact; an opening biasing unit that biases the output lever so as to rotate the output lever in a predetermined direction; a four-joint link that is fixed at one end to the main shaft, is rotatably coupled at the other end to the output lever, and is flexible and extendable; a guide that is rotatably supported by the casing, and includes a guide surface that is capable of guiding the four-joint link, while coming into contact with the four-joint link; a tripping latch that is rotatably supported by the casing and is capable of locking the guide; a tripping trigger that is rotatably supported by the casing and is capable of locking the tripping latch; a tripping electromagnet that has a plunger capable of moving back and forth toward the tripping trigger, and moves the plunger forward to rotate the tripping trigger when an opening command is input so as to make it possible to disengage the tripping latch from the tripping trigger; a switch-on lever that is fixed to the main shaft and is rotatable about the main shaft; a closing bias unit that biases the switch-on lever so as to rotate the switch-on lever in a reverse direction to the predetermined direction; a switch-on latch that is rotatably supported by the casing and is capable of locking the switch-on lever; a switch-on trigger that is rotatably supported by the casing and is capable of locking the switch-on latch; a switch-on electromagnet that has a plunger capable of moving back and forth toward the switch-on trigger, and moves the plunger forward to rotate the switch-on trigger when a closing command is input so as to make it possible to disengage the switch-on latch from the switch-on trigger; an opening-operation prevention unit that operates in conjunction with the output lever, stops the tripping trigger from rotating when the switching contact is in a closing operation, and allows the tripping trigger to rotate when the switching contact is in an opening operation; and a closing-operation prevention unit that operates in conjunction with the output lever, stops the switch-on trigger from rotating when the switching contact is in an opening operation, and allows the switch-on trigger to rotate when the switching contact is in a closing operation.

Advantageous Effects of Invention

According to the present invention, it is possible to prevent a closing operation from being performed during an opening operation with a simple structure and without any additional circuitry being provided.

DESCRIPTION OF EMBODIMENTS

Exemplary embodiments of a spring operation device for use in a switchgear according to the present invention will be described below in detail with reference to the accompanying drawings. The present invention is not limited to the embodiments.

First Embodiment

Figure 1:
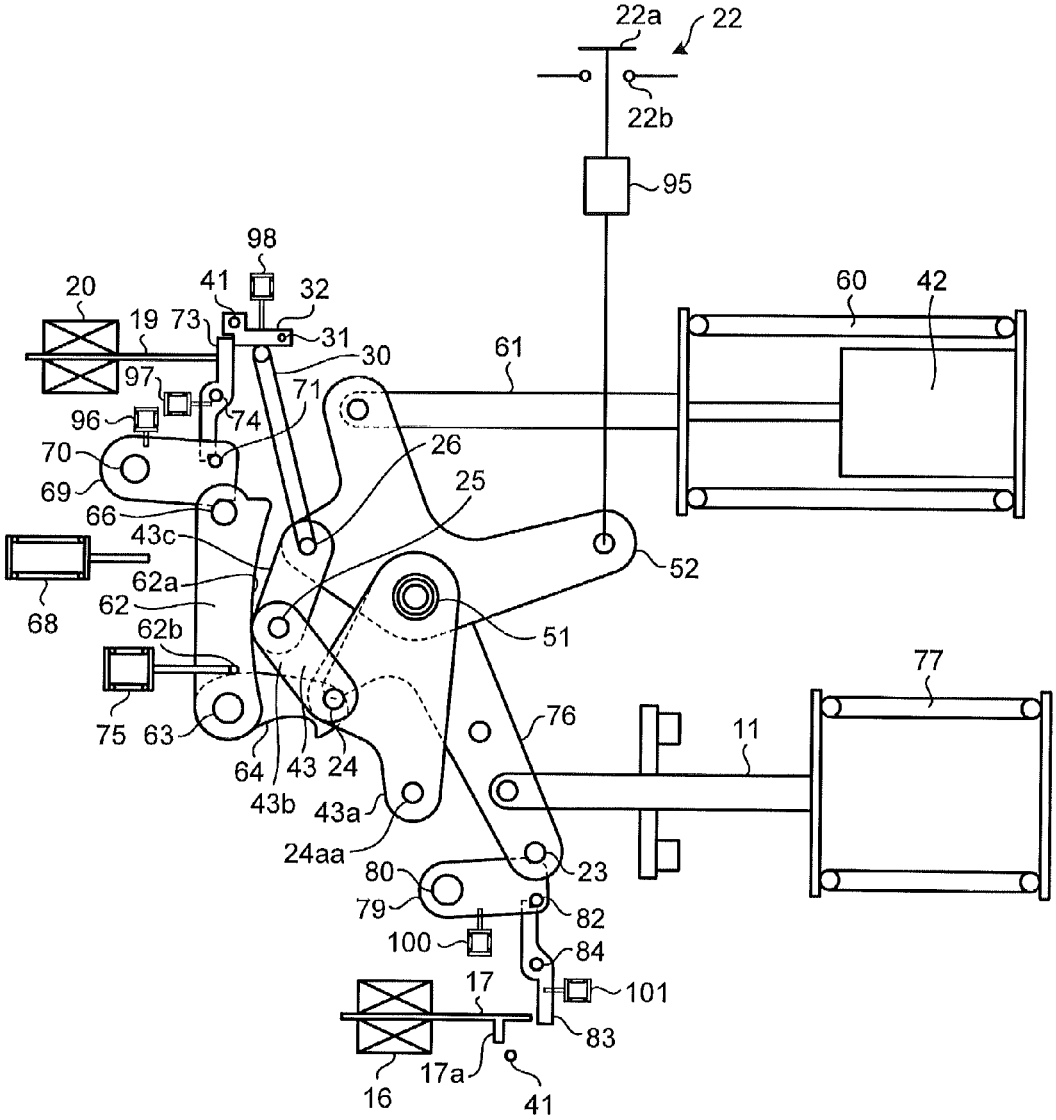
FIG. 1 is a configuration diagram of the relevant parts of a spring operation device for use in a switchgear according to a first embodiment. The specific state illustrated is that before starting a closing operation.

FIG. 1 is a configuration diagram of the relevant parts of a spring operation device for use in a switchgear according to the present embodiment. The specific state illustrated is the state before starting a closing operation. The switchgear, for example, is a breaker.

A main shaft 51 is rotatably supported by a casing (not illustrated) that serves as a support structure. An output lever 52 is attached to and fixed to the main shaft 51. The output lever 52 is rotatable about the main shaft 51. The output lever 52 is coupled to an opening coil spring 60 and a buffer 42 via a blocking link 61. The opening coil spring 60 is an example of an opening biasing unit. In FIG. 1, the opening coil spring 60 is in a released state.

A bar-shaped lock member 30 is attached to a four-joint link 43. The lock member 30 moves in conjunction with the rotation of the output lever 52. The distal end of the lock member 30 comes into and out of contact with a lock plate 32. In FIG. 1, the distal end of the lock member 30 is in contact with the lock plate 32.

A movable contact 22*a* is connected to the output lever 52. The movable contact 22*a* is capable of coming into and out of contact with a fixed contact 22*b* according to the rotation of the output lever 52. The movable contact 22*a* and the fixed contact 22*b* constitute a switching contact 22 of the breaker. The output lever 52 is coupled to the switching contact 22 via a link mechanism 95.

A switch-on lever 76 is attached to and fixed to the main shaft 51. The switch-on lever 76 is rotatable about the main shaft 51. The switch-on lever 76 is coupled to a switch-on link 11. The switch-on link 11 is coupled to a closing coil spring 77. The closing coil spring 77 is compressed by a motor, which is not illustrated, when it is biased. The closing coil spring 77 is an example of a closing bias unit. In FIG. 1, the closing coil spring 77 is in a biased state.

One end of the four-joint link 43 is attached to the main shaft 51, and the other end thereof is rotatably attached to the output lever 52 via a pin 26. Specifically, the four-joint link 43 is constituted by a link 43*a* that is fixed at its one end to the main shaft 51, a link 43*b* that is rotatably coupled to the link 43*a* via a pin 24, and a link 43*c* that is rotatably coupled to the link 43*b* via a pin 25. The link 43*c* is rotatably attached to a lever portion 52 of the output lever 52 via the pin 26. The four-joint link 43 has joints at four positions that are the main shaft 51 and the pins 24 to 26. The entirety of the four-joint link 43 is configured to be flexible and extendable. The lock member 30 is fixed to the output lever 52 via the pin 26.

A guide 62 is supported at its one end by a rotational shaft 63 provided in the casing so as to be rotatable about the rotational shaft 63. At the other end of the guide 62, a pin 66 is provided. The pin 66 is engageable with a tripping latch 69 (a first tripping latch). In FIG. 1, the pin 66 is engaged with the tripping latch 69. The guide 62 is biased by a return spring 68 so as to rotate clockwise. The guide 62 includes a substantially-arc-shaped guide surface 62*a* on the side that is opposed to the main shaft 51. In FIG. 1, a portion of the four-joint link 43 comes into contact with the guide surface 62*a*. A pin 62*b* is provided on one-end side of the guide 62 and is engageable with a tripping latch 64 (a second tripping latch), which is attached to and is rotatable about the rotational shaft 63. In FIG. 1, the pin 62*b* is engaged with the tripping latch 64. The tripping latch 64 is engageable, at its distal end, with the pin 24*aa* that is provided in the link 43*a*. In FIG. 1, the tripping latch 64 is not engaged with the pin 24. A spring 75 biases the tripping latch 64 so as to rotate the tripping latch 64 about the rotational shaft 63 clockwise.

The tripping latch 69 is attached to and is rotatable about a rotational shaft 70. The rotational shaft 70 is rotatably supported by the casing. In the tripping latch 69, a notch is provided, with which the pin 66 of the guide 62 is engageable, and also a pin 71 is provided. The pin 71 is engageable with a tripping trigger 73. In FIG. 1, the pin 71 is engaged with the tripping trigger 73. A spring 96 biases the tripping latch 69 so as to rotate the tripping latch 69 about the rotational shaft 70 clockwise.

The tripping trigger 73 is attached to and is rotatable about a rotational shaft 74. In the tripping trigger 73, a notch is provided, with which the pin 71 of the tripping latch 69 is engageable. A spring 97 biases the tripping trigger 73 so as to rotate the tripping trigger 73 about the rotational shaft 74 counterclockwise.

The lock plate 32 is attached to and is rotatable about a rotational shaft 31. The distal end of the lock plate 32 is engageable with the distal end of the tripping trigger 73. In FIG. 1, the lock plate 32 engages with the tripping trigger 73. A spring 98 biases the lock plate 32 so as to rotate the lock plate 32 about the rotational shaft 31 counterclockwise.

One end of an interlock bar 41 is fixed to the lock plate 32. The interlock bar 41 is attached to the lock plate 32 on the side opposite to the side where the lock member 30 is capable of coming into contact with the lock plate 32.

A tripping electromagnet 20 is arranged near the tripping trigger 73. The tripping electromagnet 20 has a plunger 19 that is capable of moving back and forth relative to the tripping trigger 73. The plunger 19 has a bar shape. When the tripping electromagnet 20 is energized by an opening command that is input from outside, the plunger 19 operates and moves forward toward the tripping trigger 73. The distal end of the plunger 19 is capable of coming into contact with the distal end of the tripping trigger 73. In FIG. 1, even if the plunger 19 is to be pushed out by energizing the tripping electromagnet 20 and is to rotate the tripping trigger 73 clockwise, the lock plate 32 stops this movement and thus the opening operation is forced to stop.

A pin 23 provided on the switch-on lever 76 is engageable with a switch-on latch 79. The switch-on latch 79 is attached to and is rotatable about a rotational shaft 80. The rotational shaft 80 is rotatably supported by the casing. On the switch-on latch 79, a notch is provided, with which the pin 23 of the switch-on lever 76 is engageable, and also a pin 82 is provided. The pin 82 is engageable with a switch-on trigger 83. In FIG. 1, the pin 82 engages with the switch-on trigger 83. A spring 100 biases the switch-on latch 79 so as to rotate the switch-on latch 79 about the rotational shaft 80 counterclockwise.

The switch-on trigger 83 is attached to and is rotatable about a rotational shaft 84. The rotational shaft 84 is rotatably supported by the casing. In the switch-on trigger 83, a notch is provided, with which the pin 82 of the switch-on latch 79 is engageable. A spring 101 biases the switch-on trigger 83 so as to rotate the switch-on trigger 83 about the rotational shaft 84 clockwise.

A switch-on electromagnet 16 is arranged near the switch-on trigger 83. The switch-on electromagnet 16 has a plunger 17 that is capable of moving back and forth relative to the switch-on trigger 83. The plunger 17 has substantially a bar shape and includes a flange portion 17*a*. When the switch-on electromagnet 16 is energized by a closing command that is input from outside, the plunger 17 operates and moves forward to the switch-on trigger 83. The distal end of the plunger 17 is capable of coming into contact with the distal end of the switch-on trigger 83. The flange portion 17*a* is provided on at least a portion of the body of the plunger 17 in its circumferential direction. Particularly, the flange portion 17*a* is provided on the opposite side to the switch-on trigger 83. In FIG. 1, the other end of the interlock bar 41 is in a non-contact state with the flange portion 17*a*.

Figure 2:
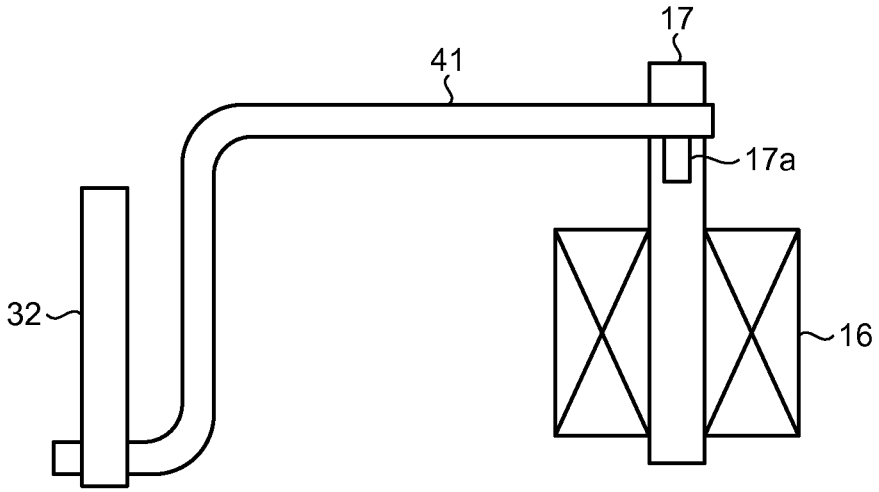
FIG. 2 illustrates the shape of an interlock bar 41.

An example of the shape of the interlock bar 41 is described below. FIG. 2 illustrates a shape of the interlock bar 41 when viewed from the front side of the flange portion 17*a*. Besides the interlock bar 41, FIG. 2 only illustrates the lock plate 32, the switch-on electromagnet 16, the plunger 17, and the flange portion 17*a*. As illustrated in FIG. 2, the interlock bar 41 has, for example, substantially a crank shape. As described above, one end of the interlock bar 41 is attached to the lock plate 32. The lock plate 32 is rotatable about the rotational shaft 31 clockwise by being pushed by the lock member 30. When the lock plate 32 rotates in this manner, the one end of the interlock bar 41 moves clockwise, and in conjunction with this movement, the other end of the interlock bar 41 also rotates clockwise.

Figure 3:
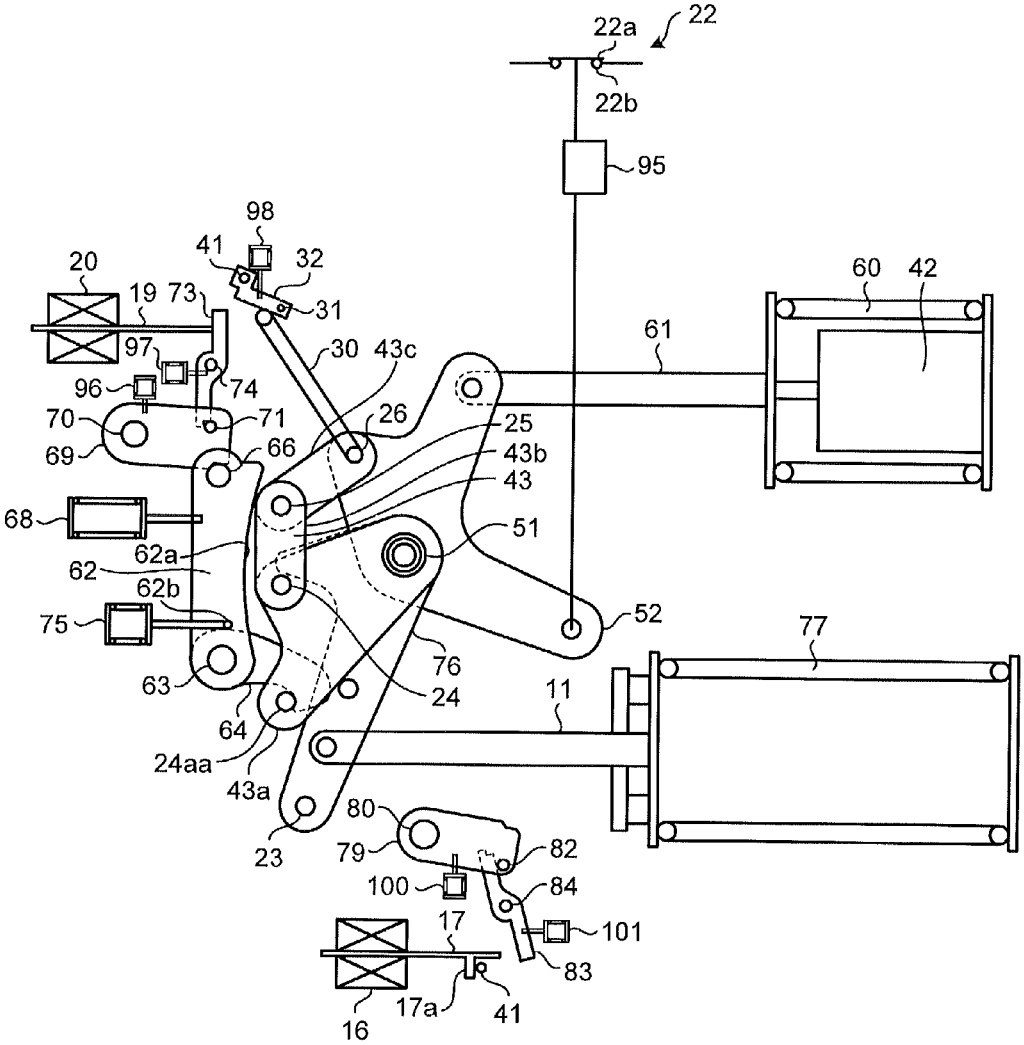
FIG. 3 is a configuration diagram of the relevant parts of the spring operation device for use in a switchgear according to the first embodiment. The specific state illustrated is a state when a closing operation has been completed.

Next, an operation performed by the present embodiment will be described. First, a closing operation is described with reference to FIGS. 1 and 3. FIG. 3 is a configuration diagram of the relevant parts of the spring operation device for use in a switchgear according to the present embodiment. The specific state illustrated is when a closing operation has been completed. The closing operation in which the state in FIG. 1 is shifted to the state in FIG. 3 is described below.

First, in FIG. 1, the switching contact 22 is in an open state, the closing coil spring 77 is in a biased state, and the opening coil spring 60 is in a released state. The switch-on lever 76 has a clockwise rotational force applied to it by the closing coil spring 77 via the switch-on link 11. However, the switch-on lever 76 is locked by the pin 23, which engages with the switch-on latch 79, and the switch-on latch 79 is locked by the pin 82, which engages with the switch-on trigger 83. The guide 62 is locked by the pin 66, which engages with the tripping latch 69. The tripping latch 69 is locked by the pin 71, which engages with the tripping trigger 73. The tripping trigger 73 is locked by its distal end engaging with the distal end of the lock plate 32. The four-joint link 43 comes into contact with the guide surface 62*a* and is supported by the guide 62. Because the lock plate 32 is not inclined with respect to the axial line of the plunger 19, one end of the interlock bar 41 (one end on the side of the switch-on trigger 83) is arranged at a position where it does not overlap with the flange portion 17*a* when viewed from the axial direction of the plunger 17 in plan view; therefore, even when the plunger 17 operates, there is no interference with the operation.

Next, a switch-on command is input to the switch-on electromagnet 16, the switch-on electromagnet 16 is energized, and the plunger 17 operates and moves toward the switch-on trigger 83. The plunger 17 pushes the switch-on trigger 83, and the switch-on trigger 83 rotates about the rotational shaft 84 counterclockwise. Thus, the switch-on latch 79 disengages from the switch-on trigger 83. At this point, because the lock plate 32 is not in an inclined state, the one end of the interlock bar 41 does not interfere with the operation of the plunger 17.

Because the switch-on trigger 83 rotates counterclockwise, and therefore disengages from the pin 82, the switch-on latch 79 then rotates about the rotational shaft 80 clockwise. Therefore, the switch-on latch 79 disengages from the switch-on lever 76.

Because the switch-on latch 79 rotates clockwise and thus disengages from the pin 23 of the switch-on lever 76, the closing coil spring 77 is then released, and the switch-on lever 76 rotates about the main shaft 51 clockwise via the switch-on link 11. Along with this rotation of the main shaft 51, the four-joint link 43 is driven so as to rotate clockwise, while being guided by the guide surface 62*a* of the guide 62 that is locked by the tripping latch 69. Therefore, the output lever 52 connecting to the main shaft 51 also rotates clockwise. Accordingly, the movable contact 22*a*, which is connected to the output lever 52, is switched on to bring the switching contact 22 into an on-state, and the opening coil spring 60 is biased via the blocking link 61 that is coupled also with the output lever 52. In this state, the tripping latch 64 engages with the pin 24*aa* provided in the link 43*a*.

Along with the rotation of the output lever 52 and the four-joint link 43 clockwise, the lock member 30 moves toward the lock plate 32 and pushes the lock plate 32. The lock plate 32 rotates about the rotational shaft 31 clockwise. Along with this rotation of the lock plate 32, the interlock bar 41 also rotates clockwise. The one end of the interlock bar 41 moves to be above the flange portion 17*a* of the plunger 17. That is, the one end of the interlock bar 41 becomes arranged at a position where it overlaps with the flange portion 17*a* when viewed from the axial direction of the plunger 17 in plan view. Thus as described above, the switching contact 22 is brought into a closed state in FIG. 3.

Because the four-joint link 43 is supported by the guide surface 62*a* of the guide 62, which is locked by the tripping latch 69, the opening coil spring 60 can maintain its biased state, and the switching contact 22 can maintain its closed state.

Figure 4:
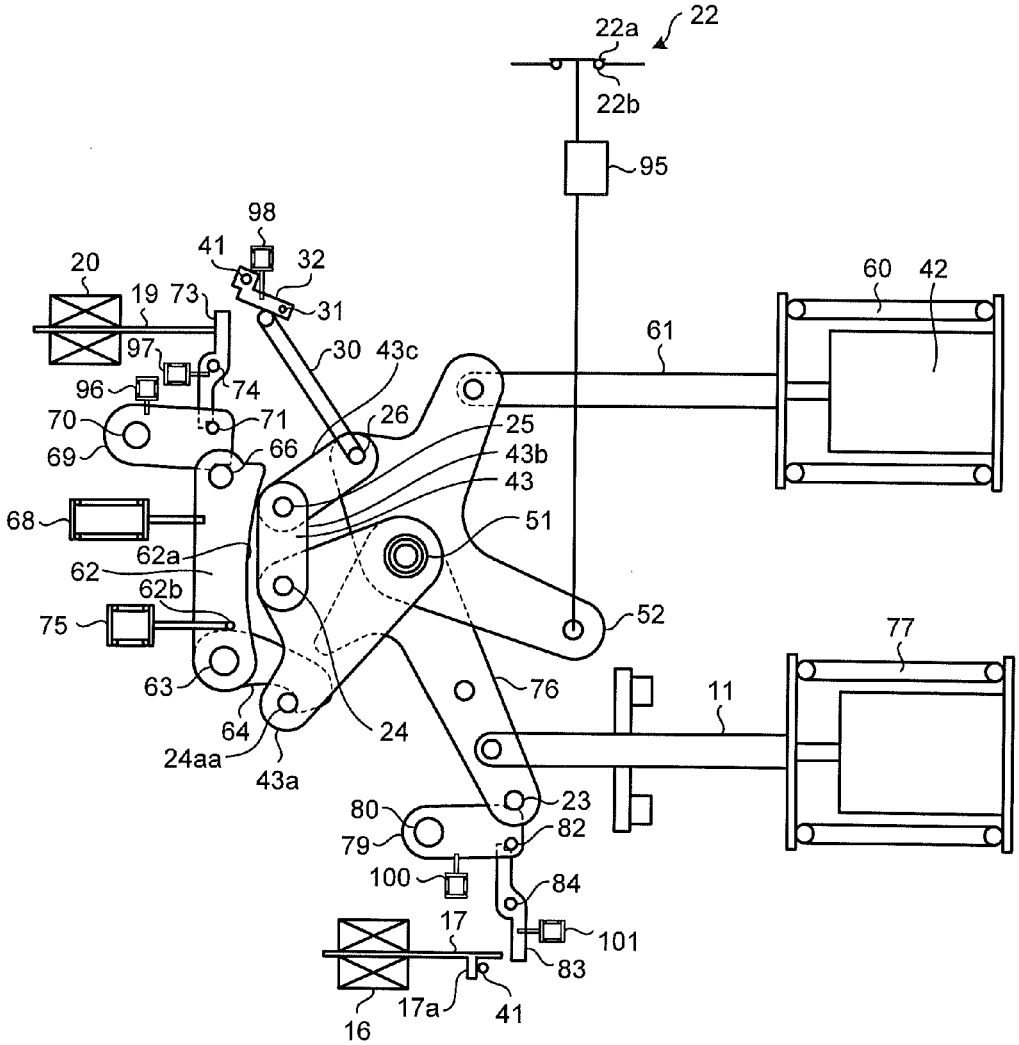
FIG. 4 is a configuration diagram of the relevant parts of the spring operation device for use in a switchgear according to the first embodiment. The specific state illustrated is at the start of an opening operation.
Figure 5:
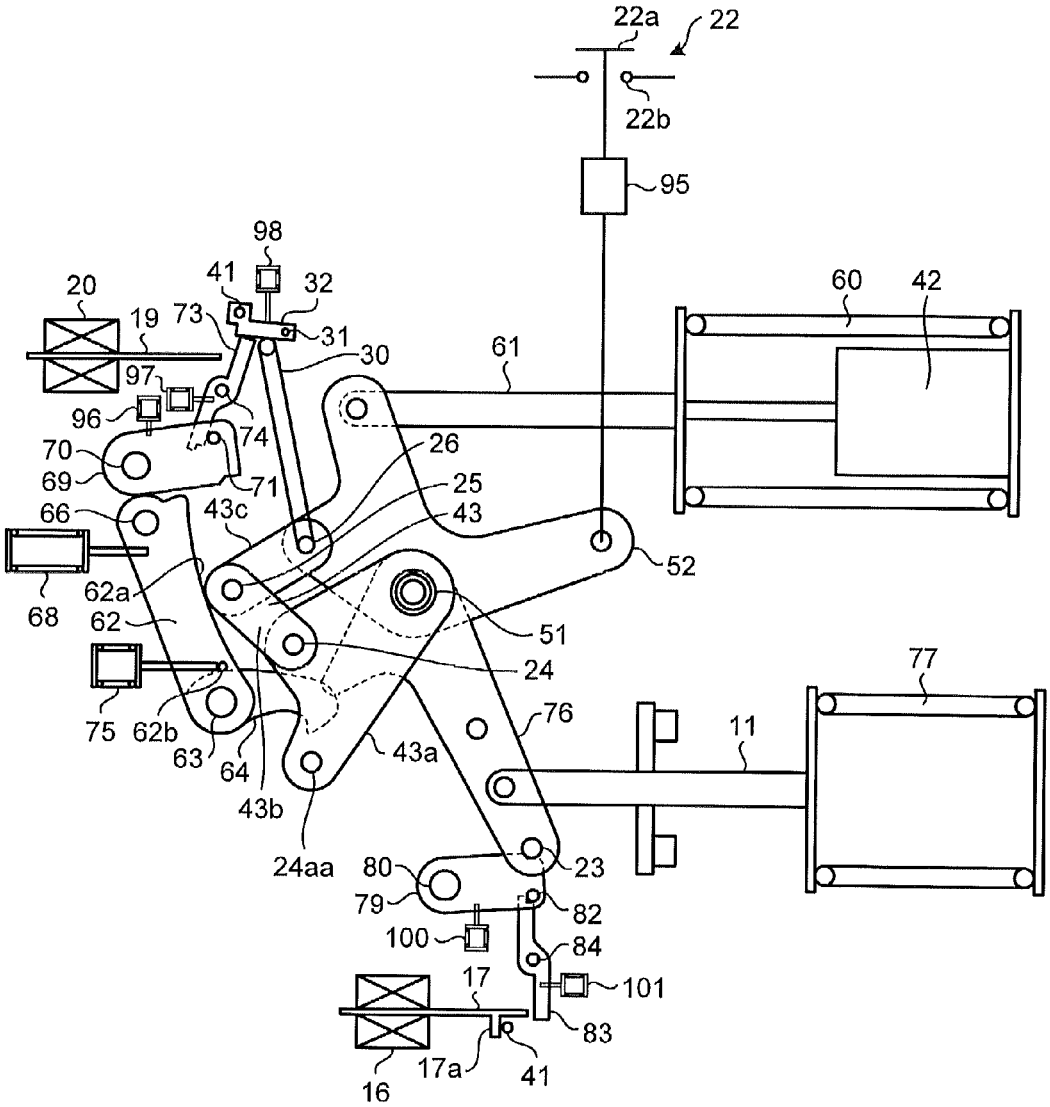
FIG. 5 is a configuration diagram of the relevant parts of the spring operation device for use in a switchgear according to the first embodiment. The specific state illustrated is when the opening operation has been completed.

Next, an opening operation is described with reference to FIGS. 4 and 5. FIG. 4 is a configuration diagram of the relevant parts of the spring operation device for use in a switchgear according to the present embodiment. The specific state illustrated is at the start of an opening operation. FIG. 4 illustrates a state where the closing coil spring 77 is biased by a motor (not illustrated) after the state illustrated in FIG. 3. FIG. 5 is a configuration diagram of the relevant parts of the spring operation device for use in a switchgear according to the present embodiment. The specific state illustrated is when the opening operation has been completed. The opening operation, in which the state in FIG. 4 is shifted to the state in FIG. 5, is described below.

In the state in FIG. 4, an opening command is input to the tripping electromagnet 20, the tripping electromagnet 20 is energized, and the plunger 19 operates and moves toward the tripping trigger 73 so as to push the tripping trigger 73. Therefore, the tripping trigger 73 rotates about the rotational shaft 74 clockwise and disengages from the pin 71 of the tripping latch 69.

At this time, the lock plate 32 is pushed by the lock member 30 and is thus in an inclined state in the clockwise direction with respect to the axial direction of the plunger 19. Therefore, the lock plate 32 does not interfere with the operation of the tripping trigger 73. The interlock bar 41 is in a state where it has followed the lock plate 32 and rotated clockwise. One end of the interlock bar 41 is arranged above the flange portion 17*a* of the plunger 17. Consequently, even if a switch-on command is input to the switch-on electromagnet 16 and then the plunger 17 tries to operate, the one end of the interlock bar 41 comes into contact with the flange portion 17*a* so as to stop the plunger 17 from operating. Consequently, the switch-on operation is prevented from being performed.

Because the pin 71 of the tripping latch 69 disengages from the tripping trigger 73, the tripping latch 69 rotates about the rotational shaft 70 counterclockwise; therefore, the tripping latch 69 disengages from the pin 66 of the guide 62.

Because the tripping latch 69 rotates counterclockwise and therefore disengages from the pin 66 of the guide 62, the guide 62 is then rotated about the rotational shaft 63 counterclockwise by the opening coil spring 68.

Because the guide 62 rotates counterclockwise, the four-joint link 43 is then lowered and the opening coil spring 60 is released. This releasing force is transmitted to the output lever 52 via the blocking link 61. The output lever 52 rotates about the main shaft 51 counterclockwise, the movable contact 22*a* is opened to bring the switching contact 22 into an off-state, and thus the opening operation is completed. In this state, the tripping latch 64 disengages from the pin 24*aa* provided in the link 43*a*. The output lever 52 rotates counterclockwise, so the distal end of the lock member 30 comes out of contact with the lock plate 32.

Figure 6:
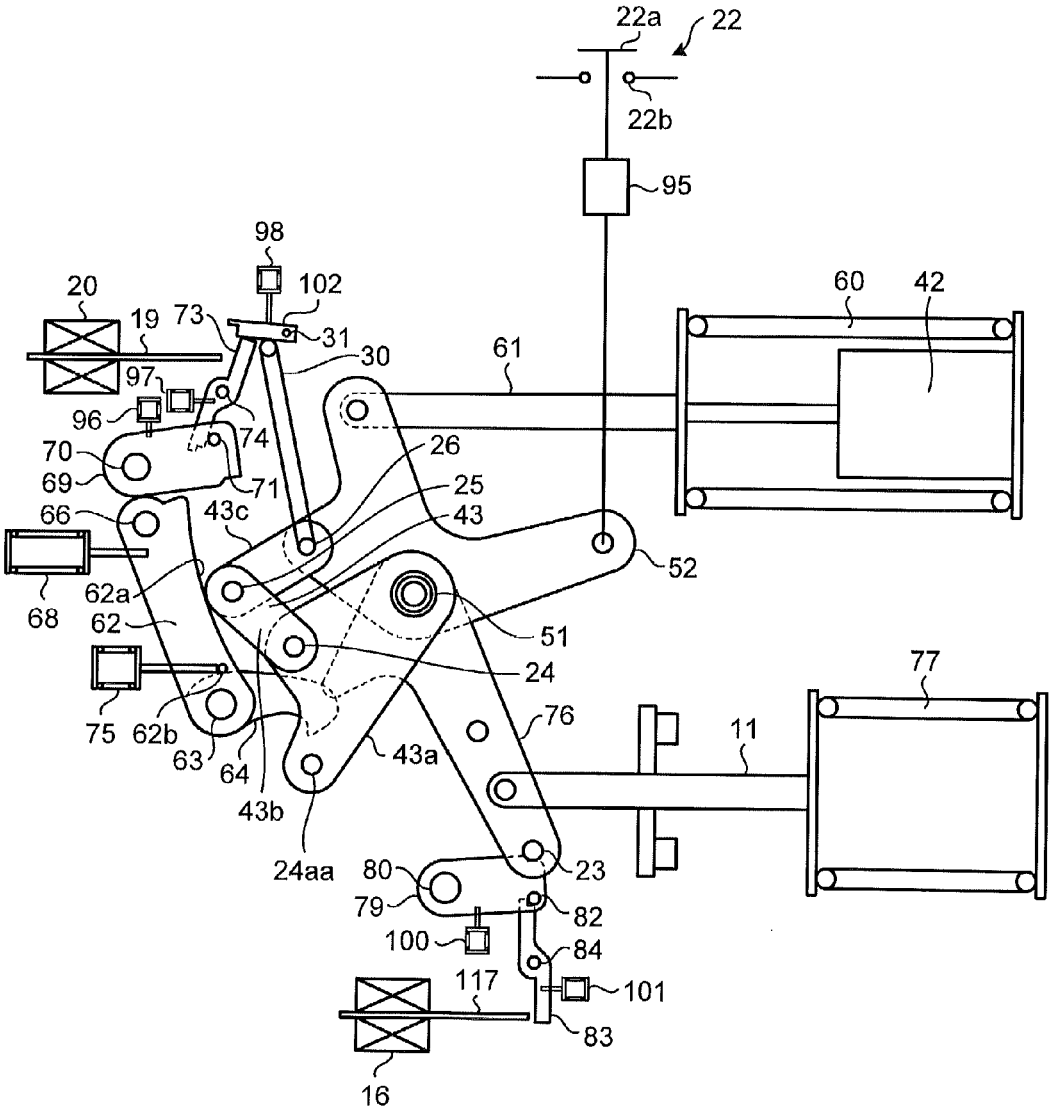
FIG. 6 is a configuration diagram of the relevant parts of a spring operation device for use in a switchgear according to an example used for comparison. The specific state illustrated is when an opening operation has been completed.

Next, the effects of the present embodiment are described with reference to FIGS. 4 to 6. FIG. 6 is a configuration diagram of the relevant parts of a spring operation device for use in a switchgear according to an example used here for comparison. The specific state illustrated is when an opening operation has been completed.

In FIGS. 4 and 5, the closing coil spring 77 is biased and the spring operation device is in a state of being capable of performing a closing operation. In this state, because the lock plate 32 is inclined clockwise with respect to the axial direction of the plunger 19, one end of the interlock bar 41 is positioned to interfere with the operation of the plunger 17. Even if a closing command is input to the switch-on electromagnet 16, the flange portion 17*a* of the plunger 17 is blocked by the one end of the interlock bar 41, and thus the operation of the plunger 17 is stopped. The plunger 17 cannot rotate the switch-on trigger 83. This prevents the closing operation from being performed during the opening operation.

As described above, in the present embodiment, only in a state where the guide 62, the tripping latch 69, the tripping trigger 73, and the lock plate 32 engage with each other, can the plunger 17, having been interlocked by the interlock bar 41, be brought into an unlocked state, which in turn makes it possible to perform a closing operation. In a state where the guide 62, the tripping latch 69, the tripping trigger 73, and the lock plate 32 disengage from each other, the plunger 17 is interlocked by the interlock bar 41, which makes it impossible to perform a closing operation.

In contrast, in FIG. 6, the lock plate 32 in FIGS. 4 and 5 is replaced with a lock plate 102, the plunger 17 in FIGS. 4 and 5 is replaced with a plunger 117 that does not include a flange portion, and the interlock bar 41 in FIGS. 4 and 5 is not provided. Aside from these points, the configuration illustrated in FIG. 6 is identical to the configuration illustrated in FIGS. 4 and 5.

The spring operation device for use in a switchgear according to this example used for here comparison has a structure in which, at the closing operation, the opening coil spring 60 is compressed such that the guide 62, the tripping latch 69, the tripping trigger 73, and the lock plate 102 engage with each other. However, while during an opening operation, the guide 62, the tripping latch 69, the tripping trigger 73, and the lock plate 102 disengage from each other in the same manner as in the present embodiment, a unit that stops the operation of the plunger 117 (such as the interlock bar 41 in FIGS. 4 and 5) is not provided. Therefore, when, in this state, a closing command is improperly input, the four-joint link 43 is not supported by the guide 62 and is thus brought into a non-rotatable state. Consequently, the opening coil spring 60 is not biased, and its load is reduced accordingly, which increases the closing speed of the movable contact 22*a*. This leads to a problem in that the spring operation device may be damaged.

In the present embodiment, there are provided the lock member 30 that operates in conjunction with the output lever 52 or the four-joint link 43; the lock plate 32 that is pushed by the lock member 30 to operate also in conjunction with the output lever 52 or the four-joint-link 43; the interlock bar 41 that operates in conjunction with the lock plate 32; and the flange portion 17*a* of the plunger 17 of the switch-on electromagnet 16. It is possible to control the operation of the plunger 17 of the switch-on electromagnet 16 in accordance with the position of the lock plate 32.

That is, when an opening operation is performed, the lock plate 32 is in a state where it has been pushed by the lock member 30 and rotated counterclockwise, and the tripping trigger 73 is allowed to rotate. Meanwhile, when the interlock bar 41 rotates clockwise, one end of which moves to be above the flange portion 17*a* of the plunger 17 of the switch-on electromagnet 16. Therefore, the plunger 17 is brought into an interlocked state by the interlock bar 41. Even if a closing operation command is transmitted to the switch-on electromagnet 16, the operation of the plunger 17 is limited, and thus the switch-on trigger 83 is stopped from rotating. Consequently, a closing operation is not performed.

When performing a closing operation, the lock plate 32 is not pushed by the lock member 30 and is thus engaged with the tripping trigger 73. The interlock bar 41 does not interfere with the operation of the plunger 17, thereby allowing the switch-on trigger 83 to rotate. Meanwhile, even if an opening operation command is transmitted to the tripping electromagnet 20, the lock plate 32 stops the rotational operation of the tripping trigger 73 resulting from the operation of the plunger 19. Thus, an opening operation is not performed.

As described above, the interlock bar 41 and the flange portion 17*a* constitute a closing-operation prevention unit during the performance of an opening operation. The interlock bar 41 that constitutes the closing-operation prevention unit operates in conjunction with the output lever 52 or the four-joint link 43. The closing-operation prevention unit stops the switch-on trigger 83 from rotating during the performance of an opening operation and allows the switch-on trigger 83 to rotate when a closing operation is performed. The lock plate 32 and the lock member 30 constitute an opening-operation prevention unit when a closing operation is performed. The lock plate 32 and the lock member 30, which constitute the opening-operation prevention unit, operate in conjunction with the output lever 52 or the four-joint link 43. The lock plate 32 and the lock member 30 stop the tripping trigger 73 from rotating when a closing operation is performed and allow the tripping trigger 73 to rotate when an opening operation is performed.

According to the present embodiment, there is no need to provide an additional control circuit, and a closing operation can be effectively prevented from being performed during an opening operation with a simple structure.

In the present embodiment, the closing coil spring 77 is used as a closing bias unit, and the opening coil spring 60 is used as an opening biasing unit. However, instead of using these coil springs, torsion bars can be used. For example, Patent Literature 1 describes a case in which a coil spring is used as a biasing unit and a case in which a torsion bar is used. In the present embodiment also, by applying the configurations described in Patent Literature 1, for example, a torsion bar can be used instead of a coil spring.

Second Embodiment

Figure 7:
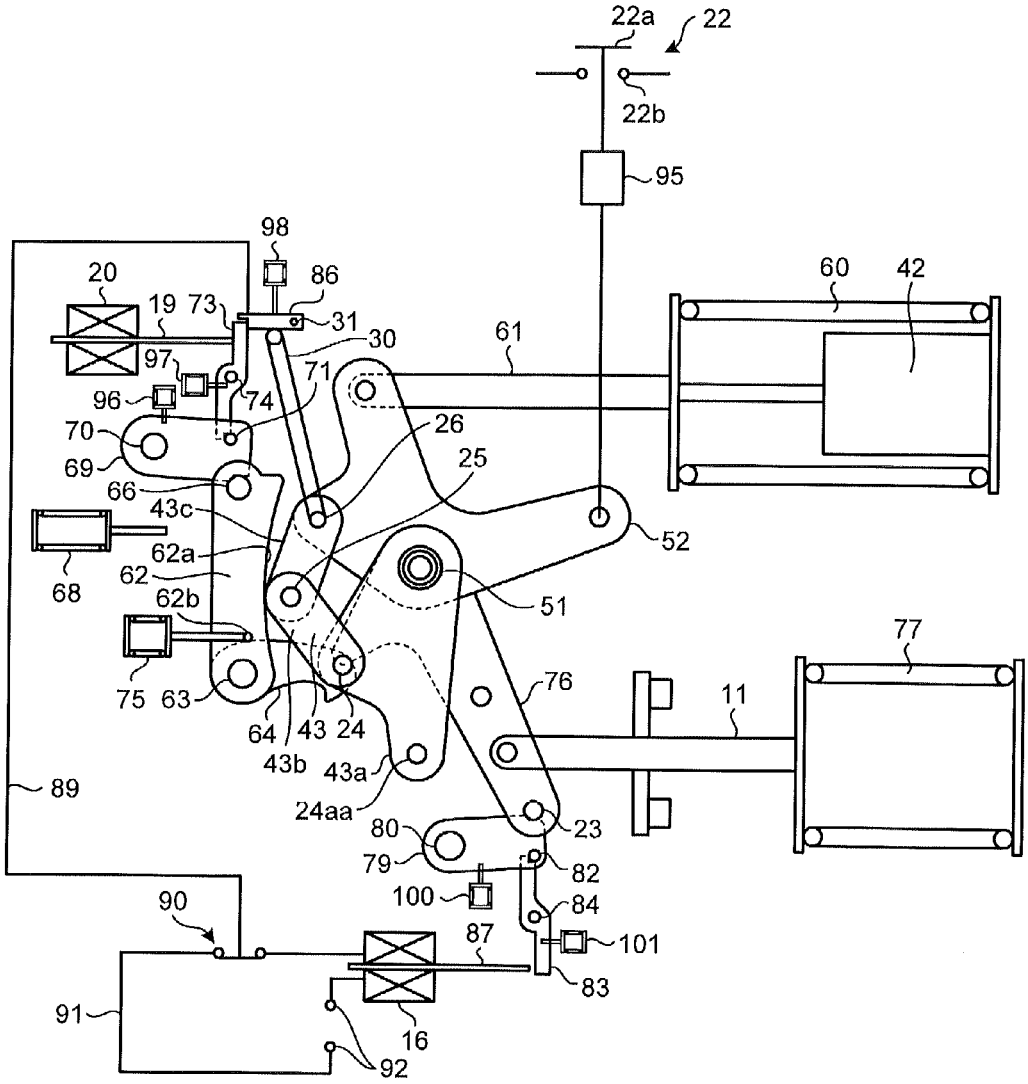
FIG. 7 is a configuration diagram of the relevant parts of a spring operation device for use in a switchgear according to a second embodiment. The specific state illustrated is that before starting a closing operation.
Figure 8:
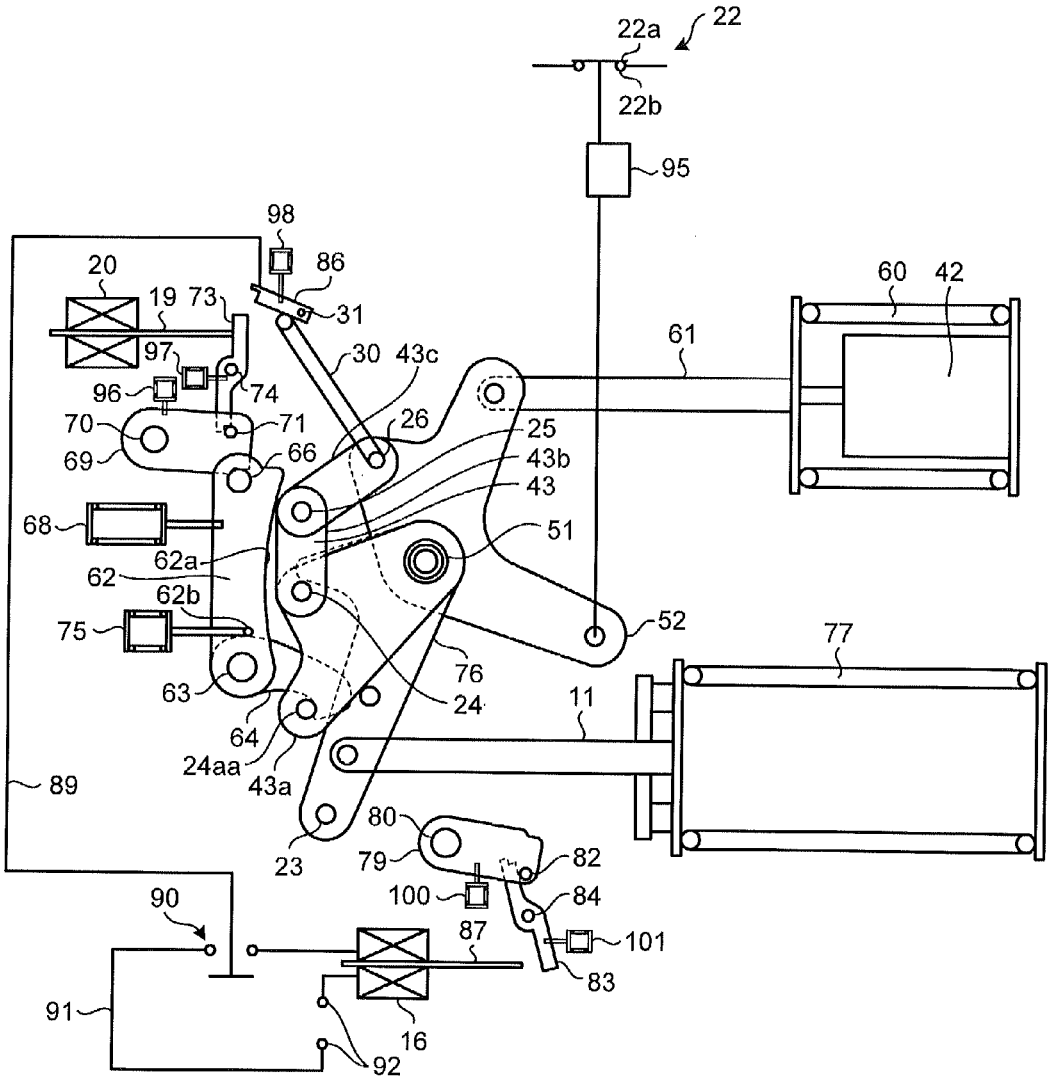
FIG. 8 is a configuration diagram of the relevant parts of the spring operation device for use in a switchgear according to the second embodiment. The specific state illustrated is when the closing operation has been completed.
Figure 9:
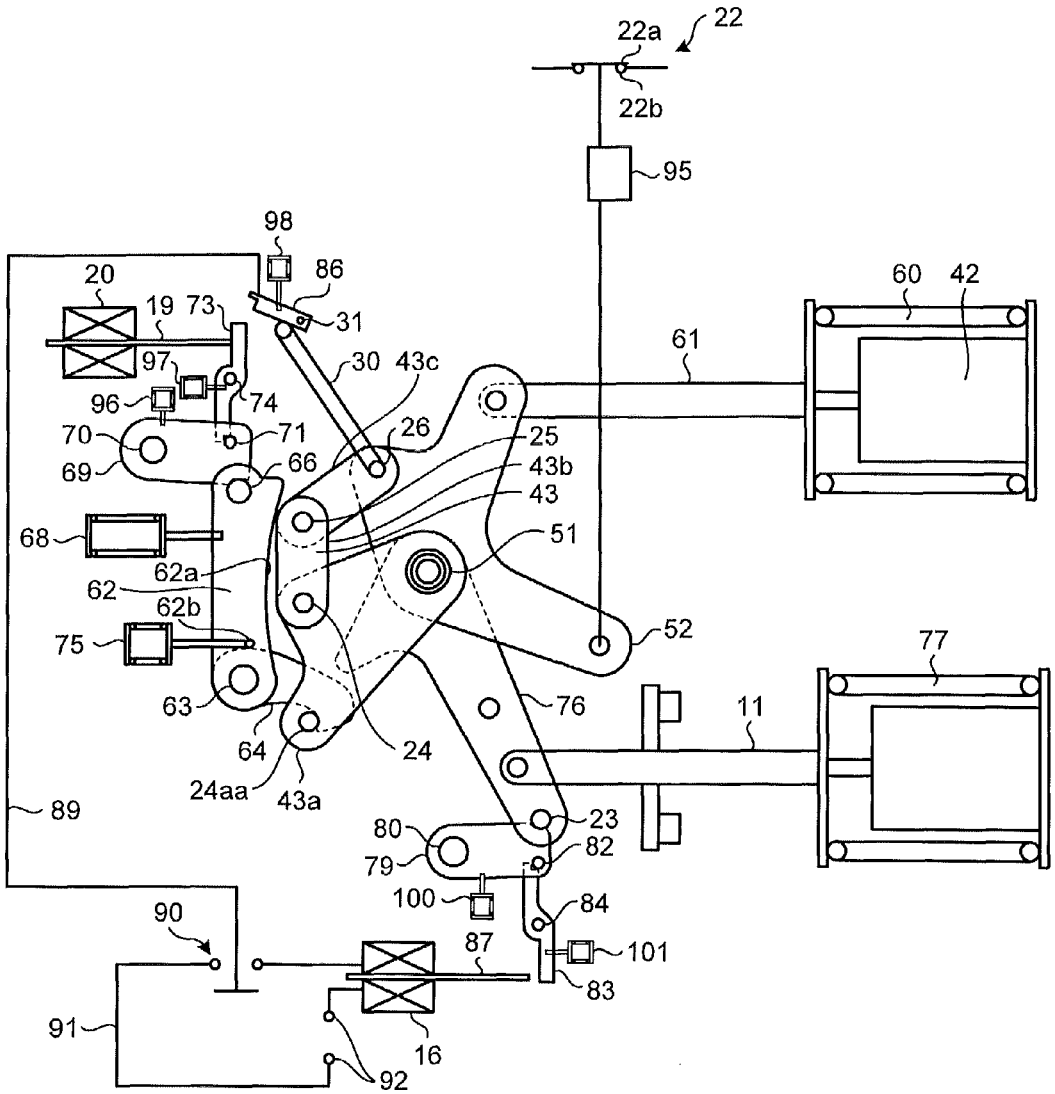
FIG. 9 is a configuration diagram of the relevant parts of the spring operation device for use in a switchgear according to the second embodiment. The specific state illustrated is at the start of an opening operation.
Figure 10:
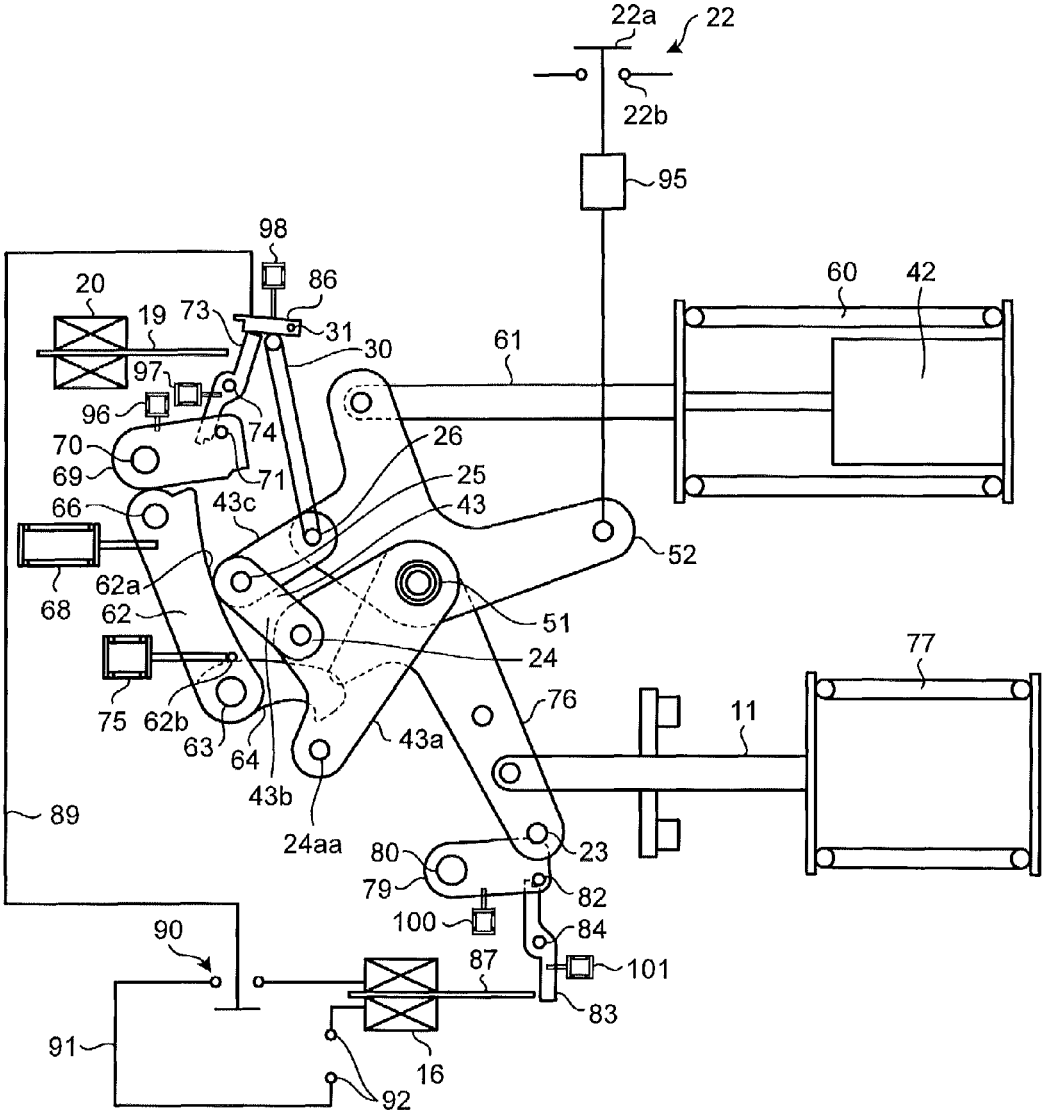
FIG. 10 is a configuration diagram of the relevant parts of the spring operation device for use in a switchgear according to the second embodiment. The specific state illustrated is when the opening operation has been completed.

FIG. 7 is a configuration diagram of the relevant parts of the spring operation device for use in a switchgear according to the present embodiment. The specific state illustrated is before starting a closing operation. FIG. 8 is a configuration diagram of the relevant parts of the spring operation device for use in a switchgear according to the present embodiment. The specific state illustrated is when the closing operation has been completed. FIG. 9 is a configuration diagram of the relevant parts of the spring operation device for use in a switchgear according to the present embodiment. The specific state illustrated is at the start of an opening operation. FIG. 10 is a configuration diagram of the relevant parts of the spring operation device for use in a switchgear according to the present embodiment. The specific state illustrated is when the opening operation has been completed. FIGS. 7 to 10 respectively correspond to FIG. 1 and FIGS. 3 to 5. In FIGS. 7 to 10, constituent elements identical to those illustrated in FIG. 1 and FIGS. 3 to 5 are denoted by like reference letters and numbers.

FIGS. 7 to 10 illustrate a switch-on control line 91 that is connected to the switch-on electromagnet 16. The switch-on control line 91 is used for transmitting a closing command, which is input from a switch-on control-line connection terminal 92, to the switch-on electromagnet 16. In the present embodiment, a limit switch 90 is provided at a certain location on the switch-on control line 91. The limit switch 90 is turned on/off in conjunction with the operation of a lock plate 86. That is, the lock plate 86 is rotatable about the rotational shaft 31, and when the lock plate 86 is inclined with respect to the axial direction of a plunger 87 so as to disengage from the tripping trigger 73 (FIGS. 8 to 10), the limit switch 90 enters an off-state; and when the lock plate 86 engages with the tripping trigger 73 (FIG. 7), the limit switch 90 enters an on-state. A member 89, which is connected to the lock plate 86, moves according to the rotating position of the lock plate 86, thereby turning on/off the limit switch 90. In FIGS. 7 to 10, the member 89 is illustrated as a line for the sake of simplicity.

In the present embodiment, the interlock bar 41 provided in the first embodiment is not provided, and the plunger 87 of the switch-on electromagnet 16 does not include a flange portion.

In FIG. 7, the guide 62 engages with the tripping latch 69; the tripping latch 69 engages with the tripping trigger 73; and the tripping trigger 73 engages with the lock plate 86. In this case, because the tripping trigger 73 engages with the lock plate 86, the limit switch 90 is brought into an on-state. Therefore, a closing command that is input from the switch-on control-line connection terminal 92 is transmitted to the switch-on electromagnet 16 via the switch-on control line 91. The switch-on electromagnet 16 receives the closing command and is energized, and the plunger 87 operates, pushes and rotates the switch-on trigger 83, thus starting a closing operation.

In contrast, in FIG. 9, the lock plate 86 rotates about the rotational shaft 31 clockwise, and the tripping trigger 73 disengages from the lock plate 86. Therefore, the limit switch 90 is brought into an off-state. A closing command cannot be transmitted to the switch-on electromagnet 16 via the switch-on control line 91, so a closing operation is prevented from being performed. That is, also in the present embodiment, a closing operation during an opening operation is prevented from being performed.

As described above, in the present embodiment, the closing-operation prevention unit is configured to include the limit switch 90, which is provided at a certain location on the switch-on control line 91 that is used for transmission of a closing command to the switch-on electromagnet 16 and which is turned on/off in conjunction with the rotating position of the lock plate 86. Interlocking is achieved by electrically turning on/off instead of by using an interlock bar, which is what is described in the first embodiment. Note that the present invention has the same configuration, operation, and effects as those described in the first embodiment except in the way that the interlocking is performed.

INDUSTRIAL APPLICABILITY

As described above, the present invention is useful as a spring operation device for use in a switchgear.

REFERENCE SIGNS LIST

11 switch-on link, 16 switch-on electromagnet, 17, 19, 87, 117 plunger, 17*a* flange portion, 20 tripping electromagnet, 22 switching contact, 23, 24, 24*aa*, 25, 26, 62*b*, 66, 71, 82 pin, 30 lock member, 31, 63, 70, 74, 80, 84 rotational shaft, 32, 86, 102 lock plate, 41 interlock bar, 42 buffer, 43 four-joint link, 43*a* to 43*c* link, 51 main shaft, 52 output lever, 52 lever portion, 60 opening coil spring, 61 blocking link, 62 guide, 62*a* guide surface, 68 return spring, 64, 69 tripping latch, 73 tripping trigger, 75, 96 to 98, 100, 101 spring, 76 switch-on lever, 77 closing coil spring, 79 switch-on latch, 83 switch-on trigger, 90 limit switch, 91 switch-on control line, 92 switch-on control-line connection terminal, 95 link mechanism.

The invention claimed is:

1. A spring operation device for use in a switchgear, comprising:

a main shaft that is rotatably supported by a casing;

an output lever that is fixed to the main shaft, is rotatable about the main axis, and is coupled to a switching contact;

an opening biasing unit that biases the output lever so as to rotate the output lever in a predetermined direction;

a four-joint link that is fixed at one end to the main shaft, is rotatably coupled at the other end to the output lever, and is flexible and extendable;

a guide that is rotatably supported by the casing, and includes a guide surface that is capable of guiding the four-joint link, while coming into contact with the four-joint link;

a tripping latch that is rotatably supported by the casing and is capable of locking the guide;

a tripping trigger that is rotatably supported by the casing and is capable of locking the tripping latch;

a tripping electromagnet that has a plunger capable of moving back and forth toward the tripping trigger, and moves the plunger forward to rotate the tripping trigger when an opening command is input so as to make it possible to disengage the tripping latch from the tripping trigger;

a switch-on lever that is fixed to the main shaft and is rotatable about the main shaft;

a closing bias unit that biases the switch-on lever so as to rotate the switch-on lever in a reverse direction to the predetermined direction;

a switch-on latch that is rotatably supported by the casing and is capable of locking the switch-on lever;

a switch-on trigger that is rotatably supported by the casing and is capable of locking the switch-on latch;

a switch-on electromagnet that has a plunger capable of moving back and forth toward the switch-on trigger, and moves the plunger forward to rotate the switch-on trigger when a closing command is input so as to make it possible to disengage the switch-on latch from the switch-on trigger;

an opening-operation prevention unit that includes a lock member that is attached to the four-joint link and that moves along with the rotation of the output lever, and a lock plate that rotates due to being pushed by the lock member along with the rotation of the output lever in the reverse direction, wherein when a closing operation is performed by the switching contact, engages with the tripping trigger so as to stop the tripping trigger from rotating, and when an opening operation is performed by the switching contact, is pushed by the lock member and disengages from the tripping trigger so as to allow the tripping trigger to rotate; and a closing-operation prevention unit that includes an interlock bar that is substantially-crank-shaped and is attached at one end to the lock plate to operate in conjunction with the lock plate, and a flange portion that is provided on the plunger of the switch-on electromagnet, wherein the other end of the interlock bar, when an opening operation is performed by the switching contact, is arranged above the flange portion and stops the plunger of the switch-on electromagnet from moving forward so as to stop the switch-on trigger from rotating, and when a closing operation is performed by the switching contact, is arranged at a position that does not stop the plunger of the switch-on electromagnet from moving forward so as to allow the switch-on trigger to rotate.

2. The spring operation device for use in a switchgear according to claim 1, wherein when the closing command is input to the switch-on electromagnet, the plunger of the switch-on electromagnet moves forward so as to disengage the switch-on trigger from the switch-on latch, and thereafter the switch-on latch disengages from the switch-on lever, and then if conditions are such that the guide engages with the tripping latch, the tripping latch engages with the tripping trigger, and the tripping trigger cannot rotate due to the action of the opening-operation prevention unit, the closing bias unit, which has been biased, is then released so that the switch-on lever rotates in the reverse direction and, along with this rotation, the output lever also rotates in the reverse direction so as to close the switching contact and to bias the bias unit, and when the opening command is input to the tripping electromagnet, the plunger of the tripping electromagnet moves forward so as to disengage the tripping trigger from the tripping latch, and thereafter the tripping latch disengages from the guide, and then if conditions are such that the switch-on trigger cannot rotate due to the action of the closing-operation prevention unit, the opening biasing unit, which has been biased, is released so that the output lever rotates in the predetermined direction and, along with this rotation, the switching contact is opened.

3. The spring operation device for use in a switchgear according to claim 1, wherein the opening biasing unit and the closing bias unit are coil springs.

4. The spring operation device for use in a switchgear according to claim 1, wherein the opening biasing unit and the closing bias unit are torsion bars.

* * * * *